United States Patent [19]

Parkinson

[11] Patent Number: 4,544,183

[45] Date of Patent: Oct. 1, 1985

[54] IDENTIFICATION CARD WITH A RADIANT ENERGY REACTIVE COATING

[75] Inventor: Dean B. Parkinson, Redwood City, Calif.

[73] Assignee: Computer Identification Systems, Calumet City, Ill.

[21] Appl. No.: 520,667

[22] Filed: Aug. 5, 1983

[51] Int. Cl.[4] ..... B42D 15/00; B05D 3/06

[52] U.S. Cl. ..... 283/85; 427/54.1

[58] Field of Search ..... 283/75, 77, 85, 91, 283/100, 111, 112, 906, 904; 430/10, 338, 344, 271, 280; 427/54.1; 346/223

[56] References Cited

U.S. PATENT DOCUMENTS

| | | | |
|---|---|---|---|
| 3,520,758 | 7/1970 | Wiest | 283/112 |
| 3,732,119 | 5/1973 | Churchill et al. | 283/91 |
| 3,930,924 | 1/1976 | Oka et al. | 283/75 |
| 4,052,739 | 10/1977 | Hasanobu et al. | 283/91 |
| 4,307,899 | 12/1981 | Hoppe | 283/91 |
| 4,451,068 | 5/1984 | Hall et al. | 283/94 |

*Primary Examiner*—Paul A. Bell
*Assistant Examiner*—Paul M. Heyrana, Sr.
*Attorney, Agent, or Firm*—Nilsson, Robbins, Dalgarn, Berliner, Carson & Wurst

[57] ABSTRACT

A multi-layered engraved identification card includes a base layer having a first color and a color-changeable layer initially having a second color which is changeable to a third color contrasting with the first color upon exposure to radiant energy preferably having a wavelength of from 3,500 to 5,000 Angstroms, for a specified period of time. The color-changeable layer is initially prepared as a solution of a resin, a plasticizer, a radiant energy-sensitive coloring agent for causing the color change, and a solvent in which both the base and the resin of the solution are soluble. Alternatively, the solution may further include a cross-linkable plasticizer with a peroxide to cause the resin of the solution and the plastic of the base to be cross-linked and hence bonded permanently to the base. The engraving may be done after the color-changeable layer is formed on the base, or alternatively, the base may be first engraved and the color-changeable solution applied to the non-engraved surface regions or applied to fill the engraved depressions.

8 Claims, 5 Drawing Figures

IDENTIFICATION CARD WITH A RADIANT ENERGY REACTIVE COATING

FIELD OF THE INVENTION

The present invention relates to engraved identification cards and in particular to engraved identification cards with a color-changeable layer to provide contrast between two or more layers on an engraved card.

BACKGROUND AND SUMMARY OF THE INVENTION

Engraved identification cards are known and can be engraved utilizing any one of a number of electronic engraving systems such as those disclosed in Noda, et al., U.S. Pat. No. 3,950,608 or Wada, et al., U.S. Pat. No. 4,052,739 or any other similar engraving system. Utilizing an electronic engraving system an image can be engraved in an identification card blank by making a multiplicity of scores through one opaque colored plastic layer of the card blank into a second, different colored opaque plastic layer of the card blank. By varying the depth of the engraved scorings, the width of the regions between the scores will be varied to generate light and dark regions which make up the desired image. A complete description of such identification cards and the method of making them is disclosed in Oka, et al., U.S. Pat. No. 3,897,964 and Oka, et al., U.S. Pat. No. 3,930,924, the disclosures of which are hereby incorporated by reference.

Heretofore, to provide a useful identification card, it was necessary to initially provide a card blank where an opaque base of one color was overlaid with an opaque layer of a contrasting color so that light impinging on the engraved surface of the card would be variably reflected back to the eye of the observer according to the location and amount of top layer removed to form an observable image.

The present invention comprises a novel identification card and method for making the same by disposing a dye precursor in the form of color-changeable solution (1) over the entire surface of a card blank prior to engraving, (2) in the engraved grooves of a pre-engraved card, or (3) on the non-engraved surface regions of a pre-engraved card to form a solid color-changeable layer, and thereafter applying radiant energy for a period of time to effect a change in the color of the color-changeable layer to provide a contrast between the color-changeable layer and the base layer. Initially, the color-changeable layer will preferably be the same color as the base layer. To assure such a color coordination, it is possible to pigment the base layer to match the color of the color-changeable layer.

Preferred pigmenting compounds which cause a color change upon exposure to ultraviolet light are the triphenylmethane type dyes which are formed by a free radical initiated oxidation reaction of a near colorless aromatic amine dye precursors such as diphenylamine. The coatings are applied to vinyl or polyester base card stock. The ultraviolet light sensitivity of these compounds and the resultant color changes are disclosed in Wainer, U.S. Pat. Nos. 3,042,515 and 3,042,516, Sprague, U.S. Pat. No. 3,046,209 and Fidelman, U.S. Pat. No. 3,114,635, the teachings of which are hereby incorporated by reference.

Further, the present invention comprises a multi-layered engraved identification card and a method for making the same wherein the multi-layered identification card includes a base layer of a first color and a color-changeable layer of a second color disposed on and bonded to selected regions of the base layer. Preferably, the color of the color-changeable layer is initially the same as the first color of the base. The color of the color-changeable layer is changeable to a third color which contrasts with the first color upon the exposure of the color-changeable layer to radiant energy for a specified period of time.

In one embodiment, the color-changeable layer is diffusion-bonded to the base layer. In another embodiment, the color-changeable layer is bonded to the base by a molecular cross-linking.

The color-changeable layer is initially applied as a solution which may be a dispersion of particulated solids to one surface of the base. The solution includes a resin, a plasticizer for modifying the base material to allow diffusion of the resin thereinto, a coloring agent for causing the second color to change to the third color upon being subjected to radiant energy and a free radical-forming initiator for the reaction. Finally, the solution includes a solvent in which both the base and the resin are soluble.

In a preferred embodiment of the invention, the coloring agent is diphenylamine, although other aryl amines, carbazoles and indoles which are sensitive to certain forms of radiation such as aryl amines having the general formula

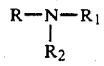

(1)

wherein R represents hydrogen, alkyl, aryl and aralkyl; $R_1$ represents alpha-naphthyl and beta-naphthyl; and $R_2$ represents an alkyl, aryl or arylalkyl group such as diphenylamine, N-methylaniline, N,N-dimethylaniline, N-ethylaniline, N,N-diethylaniline, phenyl-alphanaphthylamine, phenyl-beta-naphthylamine, triphenylamine, N-methyldiphenylamine, N-benzylaniline, N,N-dibenzylaniline, N-benzyldiphenylamine and N-beta-hydroxyethylaniline.

Additional color-changing agents include carbazoles having the formula

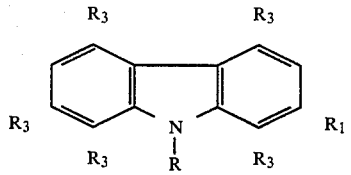

(2)

wherein $R_3$ represents hydrogen or an alkyl, aryl, aralkyl, alkoxy, halogen or dialkylamino group, the same or different, and R represents the components described with respect to formulate (1); such as carbazole, N-ethylcarbazole, N-methylcarbazole, N-phenylcarbazole and N-benzylcarbazole.

Additional color agents are indoles represented by the formula

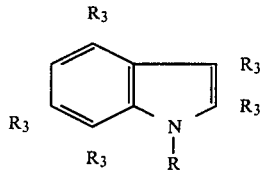

(3)

wherein R and $R_3$ represent the components described with respect to formulae (1) and (2); such as indole, 2-methylindole, 1,2-dimethylindole, 1-phenylindole and 4-chloroindole. In addition, other compounds or materials which change color upon exposure to radiant energy and which are capable of binding to polymeric identification cards in the manner described, may be used without departing from the true spirit of the invention.

In this regard, the preferred embodiment describes the use of ultraviolet radiation having a wavelength of from about 3,500 to about 5,000 Angstroms to effect the color change, other forms of electromagnetic waves such as gamma rays, X-rays, visible light rays, infrared light or microwaves may be used.

In addition, the preferred free radical initiator is carbon tetrabromide, although other halogen-containing materials having the formula $$R—CX_3 \quad (4)$$

wherein R represents hydrogen, a halogen or an alkyl, arylalkyl or aryl group which may be substituted or unsubstituted, and each X represents a halogen atom, namely, chlorine, bromine or iodine and may be the same or different from one another, as well as other free radical formers known in the art.

The solution may further comprise any additional pigmenting or dyeing agent for altering the color of the color-changeable pigment to a preselected different initial color as to match the color of the base.

It should be noted that the identification card of the present invention offers substantial advantages over cards produced by the multi-colored layering or pigmenting techniques heretofore known. Due to the nature of the liquid carrier provided for the irradiation-sensitive material, the color is attached to the base card by molecular bonding and thus provides a more durable engraved card. In addition, the color which results from the chemical change is irridescent and not obtainable or reproducable with pigments. Thus, the identification card is both attractive and forgery-proof.

The carrier solution may further comprise any additional pigmenting or dyeing agent for altering the color of the color-changeable pigment to be a preselected different initial color as to match the color of the base.

A method of making and an identification card having a base and a color-changeable layer includes initially providing a vinyl, polyvinyl chloride, polyester or Mylar TM plate or base having a first color. A solution is next prepared comprising a color-changing material as heretofore described, a free radical former, a binder for enabling diffusion bonding of the solution to the base, and a solvent in which both the resin and the base are soluble. The prepared solution is next applied as a layer to the base and the solvent allowed to evaporate causing a solid, color-changeable layer to be formed on and diffusion bonded to the base. The resultant blank card is then engraved through the color-changeable layer into the base after which the color-changeable layer is exposed to radiation to effect a change in color of the color-changeable layer. A contrast between the engraved and non-engraved portions of the engraved identification cards is thereby provided.

In accordance with another embodiment of the invention, the base is initially engraved with the solution being applied to the non-engraved surface regions. In this embodiment, the solution is provided with increased viscosity by the addition of suitable particulate fillers to prevent the solution from flowing into the engraved depressions. After the solvent is evaporated, the card is irradiated to cause a "developing" of the color-sensitive layer to effect the contrast desired between the color-changeable layer and the base.

In still a third embodiment of the invention, the base is initially engraved and the color-changeable solution thinned to have a sufficiently low viscosity to flow into and fill the engraved grooves but leave the non-engraved surface regions of the base exposed. Again, the solvent is allowed to evaporate thereby forming a hard color-changeable layer which changes color when irradiated.

BRIEF DESCRIPTION OF THE DRAWINGS

A complete understanding of the present invention and of the above and other advantages thereof may be gained from consideration of the following description of the preferred embodiments taken in conjunction with the accompaying drawings in which.

DETAILED DESCRIPTION

The preferred embodiment of the invention, set forth in the following examples, concerns the production of a color-changeable layer from the dye precursor diphenylamine,

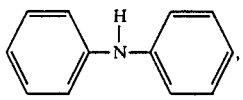

(5)

and the irradiation of said layer with ultraviolet light in the presence of a free radical initiator to form a dye, the principle component of which is known as opal blue dye,

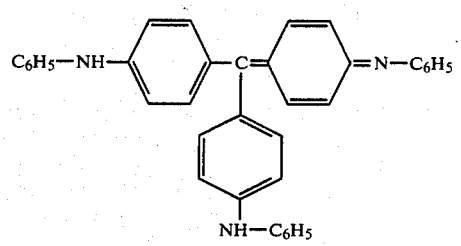

(6)

Such dyes may be stabilized by salt formation with inorganic compounds such as phosphomolydic acid or phosphotungstic acid.

The present invention comprises an engraved identification card and a method for making engraved identification cards whereby a color-changeable layer is disposed on and bonded to one surface of a base material such as a polyester card. An engraved identification card utilizing the base and the color-changeable layer may be made in any one of several different ways. For example, a blank unengraved base may first be coated with a thin layer of the color-changeable material in such a way that the color-changeable material bonds to the surface of the base. The resultant unengraved base with the color-changeable layer is then engraved utilizing available electronic engraving systems such as those disclosed in Noda, et al., U.S. Pat. No. 3,950,608 or Wada, et al., U.S. Pat. No. 4,052,739.

In another example, an unlayered base material may first be engraved. The color-changeable material is then disposed only on the unengraved surface portions of the engraved base. Alternatively, the engraved depressions in the surface of the base can be filled with the color-changeable material leaving the unengraved surface regions exposed.

Figure 1A:
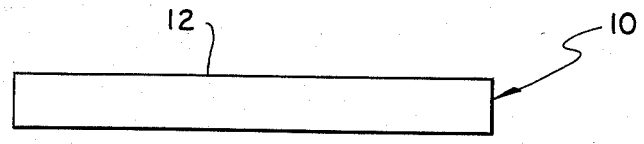
FIGS. 1A, 1B and 1C are cross-sectional side views illustrating the method of making an engraved card by first applying a color-changeable solution to one surface of a base and thereafter engraving through the color-changeable layer into the base.
Figure 1B:
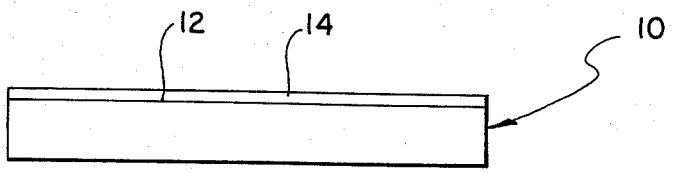
Figure 1C:
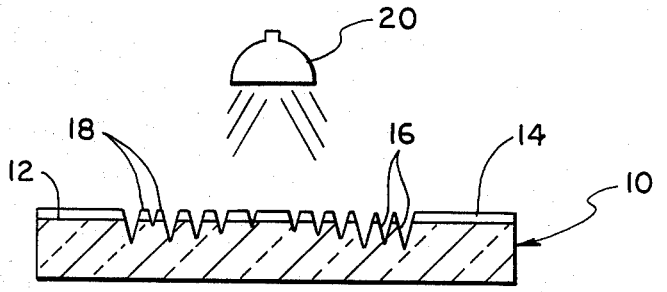

Referring initially to FIGS. 1A, 1B and 1C, one method of making an identification card in accordance with the invention is illustrated. Specifically, base 10 having a top surface 12 is first selected. The base is preferably made of mylar TM polyester but may also be made of a vinyl, cellulose acetate, polyvinyl chloride or any other material to which a color-changeable layer will bond. A solution of color-changeable material to be described hereafter is then prepared and disposed on the top surface 12 where it is cured or otherwise dried to form a color-changeable layer 14 as illustrated in FIG. 1B. In the preferred embodiment, the base 10 is pigmented to be substantially the same color as the color-changeable layer 14 so that the layered card of FIG. 1B appears to be a single-colored nonlayered card. However, the base 10 and the color-changeable layer 14 need not be precisely matched and indeed need not even be the same color in accordance with the broadest aspects of the present invention. The solution applied to form the color-changeable layer 14 is similarly pigmented or dyed. Therefore, the color-changeable layer 14 and the base 10 may be fabricated to have any of a number of different colors.

The resultant identification card with the color-changeable layer 14 illustrated in FIG. 1B is next engraved on a suitable electronic engraving machine to form a plurality of depressions or grooves 16 which extend through the color-changeable layer 14 into the base 10. The grooves or depressions 16 are of variable depth so that the surface regions 18 between grooves are of varying width. The variations in the depth of the grooves 16 and hence in the width of the nonengraved adjacent surface regions 18 define an image.

Because the color-changeable layer 14 and the base 10 are, in the preferred embodiment substantially the same color, the image defined by the combination of the engraved depression 16 and the nonengraved surface regions 18, is not easily observable and indeed can only be observed if at all, because of the variation in reflectivity from the various surfaces defining the depressions and the nonengraved regions 18. Consequently, in accordance with the invention, the color-changeable layer 14 is made of a composition which changes to a color which contrasts with the color of the base layer 10 after being exposed for a period of time to a source of radiant energy 20. A particular composition of the color-changeable layer 14 will be described hereafter. Depending upon the specific makeup of the composition and thickness of the layer 14, the change from a non-contrasting to a contrasting color may be accomplished by exposing the color-changeable layer to a slight having a wavelength of between about 3,500 and about 5,000 Angstroms for a period of time sufficient to obtain the color change desired. The length of exposed time decreases as the temperature is increased and as the thickness increases.

Figure 2:
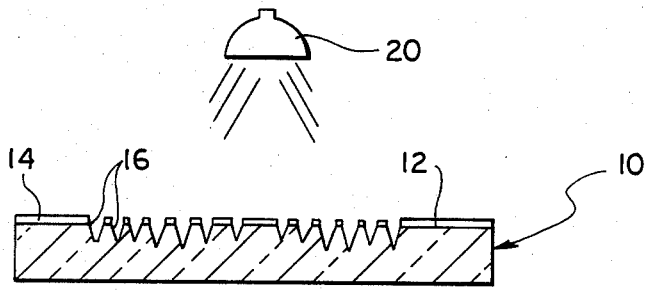
FIG. 2 is a cross-sectional side view of an engraved identification card in accordance with another embodiment where the color-changeable solution is applied after engraving.

Referring to FIG. 2, another embodiment of an identification card in accordance with the invention is illustrated. This card is made by first engraving the top surface 12 of the card blank 10. Thereafter, a solution of the color-changeable material 14 is disposed to cover only the remaining non-engraved surface regions 12 between the engraved depressions or grooves 16. One preferred method of applying the solution of color-changeable material is to use a steel or other hard surface roller covered with this solution, and thereafter rolling the roller over the card. The color-changeable solution is thereby transferred to the surface regions 12. Of course, the solution so applied must not flow so as to fill the engraved depressions 16. In order to achieve a viscosity, which will prevent such flow, fillers such as silica or calcium carbonate can be added to the solution to thereby thicken the solution and increases its viscosity. The degree of which the viscosity will be increased by the addition of fillers also depends on the particle size of the fillers. Thus, the smaller the particle size the greater the increase in viscosity.

In order to thin the solution and thereby lower the viscosity, it is merely necessary to add a solvent. The particular amount of solvent or fillers added will be determined empirically at the time that the solution is prepared.

Referring again to FIG. 2, the color-changeable solution is next allowed to dry by allowing the solvent in the solution to evaporate. The resultant color-changeable layer is then exposed to the source of ultraviolet light 20.

Figure 3:
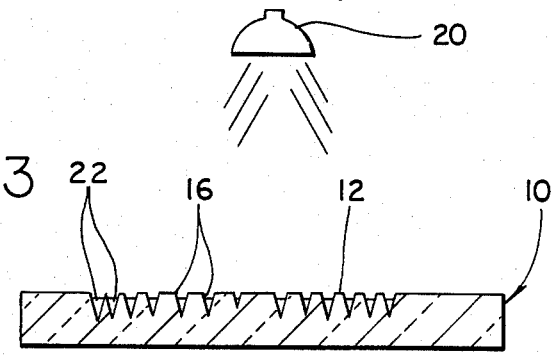
FIG. 3 illustrates another embodiment of the invention whereby the color-changeable solution is applied to fill or partially fill the engraved depressions while leaving the non-engraved surface regions exposed.

In yet another embodiment of the invention illustrated in FIG. 3, the base 10 is engraved prior to applying the color-changeable solution. However, rather than applying the color-changeable solution on the non-engraved surface regions 12 as described in connection with FIG. 2, the color-changeable solution is applied to fill the engraved grooves 16 while leaving the non-engraved surface regions 12 exposed. This may be accomplished by using a suitable Doctor blade or the like to force the solution into the grooves and yet wipe the surface regions 12 so as to be free of residual amounts of the solution. The resulting solution is then cured or otherwise dried as described above to form a solid, bonded, color-changeable layer 22 in the engraved depressions 16. The engraved card is then exposed to ultraviolet light from the source 20 for an appropriate period of time.

In accordance with the invention, the color-changeable solution is applied to the surface of the base 10 so that the resultant color-changeable layer will have a thickness in the range of about 3 to 15 microns. The solution may be applied by any of a number of different available methods such as silk screen printing, letter press, offset printing, rotogravure, spraying and masking, or any other available deposition technique.

The bonding of the color-changeable composition to the base may be accomplished by either diffusion bonding or by cross-linking of the molecules of the solution with the molecules of the base. Diffusion bonding occurs by adding suitable plasticizers to the solution to soften the top surface of the base thereby allowing the solution to diffuse into the top layer of the base. Cross-linking can be obtained by adding a cross-linking plasticizer plus a cross-linking agent such as peroxide to cause the molecules of the color-changeable layer to link to the molecules of the base.

EXAMPLE ONE

In one particular example, a solution in accordance with the invention was made by combining 1 part by weight of VMCH, a vinyl copolymer produced by Union Carbide Company as a binder, 9 parts isophorone as a solvent, 1.5 parts diphenylamine as a dye precursor and 1.5 parts carbon tetrabromide as a free radical source. This solution was coated on a glass slide using a doctor blade for drawdown and on a white mylar TM card using a glass rod for drawdown and tape shims to achieve the desired coating thickness. The solution was nearly colorless and dried to form a transparent pale yellow coating. On exposure to ultraviolet light having a wavelength in the range of 3,500 to 5,000 Å from a 275-watt sun lamp, an irridescent deep blue color was obtained. A similar solution was then provided which included 3 parts by weight of phosphotungstic acid as a stabilizer. The dried coating was initially a pale olive color which become deep blue-green upon ultraviolet light exposure.

EXAMPLE TWO

A solution was made including 1 part by weight Elvacite 2010, a polymethylmethacrylate produced by E. I. du Pont de Nemours & Co., Inc. as a binder, 6.3 parts dimethylformamide and 2.7 parts toluene as solvents, 1.5 parts diphenylamine and 1.5 parts carbon tetrabromide. The solution was coated on glass slides and test cards in a manner similar to that described in Example One. The dried coatings were transparent pale yellow in color and on exposure to ultraviolet light, a dark red-brown color was obtained. When 3 parts by weight of phosphotungstic acid were added to the solution, the dry coating was initially a pale olive color which became a deep red-brown color on ultraviolet light exposure.

EXAMPLE THREE

An initial solution was mixed including 1 part by weight Elvacite 2010 as a binder, 5.7 parts ethylenedichloride as a solvent, 1.2 parts diphenylamine as a dye precursor and 1.4 parts carbon tetrabromide as a free radical source. After application to glass slides and test cards as heretofore described, the dried coating was a transparent pale yellow in color. On exposure to ultraviolet light, a very dark blue color was obtained.

EXAMPLE FOUR

An additional solution was provided employing VMCH vinyl copolymer in an amount of 1.5 parts by weight, 3.5 parts isophorone, 0.3 parts diphenylamine and 0.5 parts P-alpha,alpha tribromoacetophenone. After coating upon base layers as described, the dried coating was a nearly colorless transparent film having an amber cast. Upon exposure to ultraviolet light, a very dark green color was obtained.

What is claimed is:

1. A multilayered identification card comprising:

a base layer having a first color, the base having a plurality of depressions of varying depths engraved therein to define an engraved image in the base; and a color-changeable layer disposed on and bonded to selected regions of the base layer, the color changeable layer initially having a second color, which color is permanently changeable, upon exposure to radiant energy for a specified period of time, to a third color which contrasts with the first color.

2. The card of claim 2 wherein the second color is permanently changeable to the third color upon exposure to ultraviolet radiation.

3. The card of claim 2 wherein the color-changeable layer is diffusion-bonded to the base layer.

4. The card of claim 2 wherein the color-changeable layer is applied to the base as a liquid dispersion comprising:

a polymeric binder;

a dye precursor for causing the color-changeable layer to change from the second to the third color when exposed to permanently ultraviolet light;

a free radical former; and a solvent in which both the base and the resin are soluble.

5. The card of claim 4 wherein the dye precursor is selected from the group consisting of

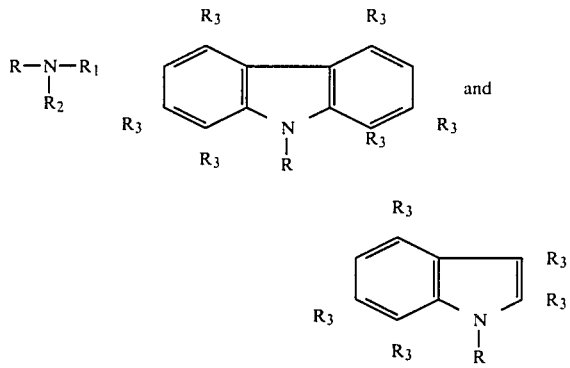

wherein:

R represents a monovalent radical selected from the group consisting of hydrogen, alkyl, aralkyl and aryl;

$R_1$ represents a member selected from the group consisting of phenyl, α-naphthyl and β-naphthyl;

$R_2$ represents a member selected from the group consisting of alkyl, aryl and aralkyl;

and each $R_3$ represents a member selected from the group consisting of hydrogen, alkyl, aryl, aralkyl, alkoxy, halogen and dialkyl amino; and may be the same or different;

and wherein the free radical former is selected from the group having the formula $$R—CX_3$$

wherein R represents a member selected from the group consisting of hydrogen, halogen, alkyl, aralkyl, aryl and substituted aryl, and each X represents a halogen atom selected from the group consisting of chlorine, bromine and iodine.

6. The card of claim 4 wherein the dye precursor is diphenylamine, the free radical former is carbon tetrabromide and the third color is a triphenylmethane dye.

7. The card according to claim 5 wherein the color changeable layer is initially a liquid dispersion comprising:

a vinyl copolymer;

a cross-linkable plasticizer reactable with the base;

a solvent in which the vinyl copolymer and the base are soluble;

a peroxide for actuating the cross-linking; and the dye precursor, whereby the plasticizer and the peroxide are selected to act to react with the base to effect molecular cross-linking between the color changeable layer and the base.

8. The card of claim 6 wherein the color changeable layer is initially a liquid dispersion comprising:

a vinyl copolymer;

a cross linkable plasticizer reactable with the base;

a solvent in which the vinyl copolymer and the base are soluble;

a peroxide for actuating the cross-linking; and the dye precursor, whereby the plasticizer and the peroxide are selected to act to react with the base to effect molecular cross-linking between the color changeable layer and the base.

* * * * *